US006386205B2

(12) United States Patent
Sartena

(10) Patent No.: US 6,386,205 B2
(45) **Date of Patent: *May 14, 2002**

(54) HAIR ADORNMENT DEVICE

(75) Inventor: Stacey Eve Sartena, Great Neck, NY (US)

(73) Assignee: Hair Blast, Inc., Kings Point, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/729,841

(22) Filed: Dec. 5, 2000

Related U.S. Application Data

(63) Continuation-in-part of application No. 09/505,405, filed on Feb. 16, 2000, now Pat. No. 6,257,250.

(51) Int. Cl.[7] ..... A41G 3/00; A45D 8/12
(52) U.S. Cl. ..... 132/53; 132/201; 132/275
(58) Field of Search ..... 132/53, 275, 277, 132/54, 55

(56) References Cited

U.S. PATENT DOCUMENTS

| | | | | |
|---|---|---|---|---|
| 250,967 | A | 12/1881 | Presser | |
| 794,479 | A | 7/1905 | Austin | |
| 1,346,718 | A | 7/1920 | Muller | |
| 1,526,440 | A | 2/1925 | Skaruda | |
| 1,594,741 | A | 8/1926 | Lewis | |
| 1,714,358 | A | 5/1929 | Finkelstein | |
| 2,201,719 | A | 5/1940 | Eicher | |
| 2,620,809 | A | 12/1952 | Rosen | |
| 2,651,310 | A | 9/1953 | Selson | |
| 2,829,654 | A | 4/1958 | Fay | |
| 2,849,007 | A | 8/1958 | Behr | |
| 3,280,826 | A | 10/1966 | Jenkins | D28/92 |
| 4,254,783 | A | 3/1981 | Kim | 132/273 |
| D261,181 | S | 10/1981 | Sands | D28/21 |
| 4,508,124 | A | 4/1985 | Franzino | |
| 4,998,186 | A | 3/1991 | Cocca | 362/103 |
| D335,390 | S | 5/1993 | Yim | D28/92 |
| D356,398 | S | 3/1995 | Hafid | D28/40 |

(List continued on next page.)

FOREIGN PATENT DOCUMENTS

| | | |
|---|---|---|
| CH | 126305 | 6/1927 |
| CH | 135892 | 12/1929 |
| CH | 362668 | 8/1962 |
| DK | 6823 | 7/1904 |
| FR | 421964 | 10/1910 |
| FR | 460804 | 12/1913 |
| FR | 540368 | 7/1922 |
| GB | 23134 | 10/1897 |

OTHER PUBLICATIONS

Hong Kong Enterprise p. 1139 #271.

Hong Kong Enterprise p. 1121 #B454M.

Henry Margu, front page, left wig with braids (copy found in design library).

Hong Kong Enterprise, Tech Ring Limited, #HET6, page unknown.

*Primary Examiner*—John J. Wilson
*Assistant Examiner*—Robyn Kieu Doan
(74) *Attorney, Agent, or Firm*—Schweitzer Cornman Gross & Bondell LLP

(57) ABSTRACT

A hair adornment device consisting of a pair of hingedly connected clip elements. Each clip element has a plurality of spaced-apart tines positioned to receive, in the spaces between them, tines of the other clip element. Each clip element has a gripping element opposite the tines. The two clip elements are pivotally connected between the tines and the gripping element. One or more lengths of hair are secured to the clip elements and substantially cover outwardly facing surfaces of the clip below the tines. The hair lengths can be secured to the clip elements, on inside or outside surfaces. Where lengths of hair are attached to both clip elements, they can extend loosely therefrom, or they can be gathered and joined adjacent to the gripping elements.

7 Claims, 9 Drawing Sheets

U.S. PATENT DOCUMENTS

| | | | | | |
|---|---|---|---|---|---|
| 5,441,061 | A | | 8/1995 | Jordan et al. | 132/275 |
| 5,501,239 | A | | 3/1996 | Walker | 132/273 |
| 5,549,127 | A | | 8/1996 | Chang | 132/277 |
| D381,119 | S | | 7/1997 | Chang | D28/40 |
| D381,767 | S | | 7/1997 | Chang | D2/501 |
| D384,786 | S | | 10/1997 | LaFauci | D2/501 |
| 5,732,720 | A | | 3/1998 | Sears | 132/128 |
| 5,803,096 | A | | 9/1998 | Lee | 132/277 |
| 5,826,593 | A | | 10/1998 | Haubrich | 132/128 |
| D403,109 | S | | 12/1998 | Potut | D28/40 |
| 5,873,377 | A | | 2/1999 | Yang | 132/277 |
| 5,890,498 | A | | 4/1999 | Kawaguchi | 132/275 |
| D410,302 | S | | 5/1999 | Yasuda | D28/40 |
| D414,583 | S | | 9/1999 | Yasuda | D28/40 |
| 6,019,107 | A | * | 2/2000 | Overmyer et al. | 132/53 |
| 6,135,125 | A | * | 10/2000 | Sartena | 132/275 |
| 6,206,011 | B1 | * | 3/2001 | Sartena | 132/275 |
| 6,247,476 | B1 | * | 6/2001 | Sartena | 132/275 |
| 6,273,097 | B1 | * | 8/2001 | Sartena | 132/275 |

* cited by examiner

HAIR ADORNMENT DEVICE

RELATED APPLICATIONS

This application is a continuation-in-part of my application Ser. No. 09/505,405, filed Feb. 16, 2000, now U.S. Pat. No. 6,257,250, granted Jul. 10, 2001.

BACKGROUND OF THE INVENTION

The present invention is directed to hair adornment devices, particularly those utilizing claw-type clips associated with one or more lengths of hair, where the hair is attached to the clip providing a simple and inexpensive, yet attractive means for adorning the hair of the user.

SUMMARY OF THE INVENTION

The present invention is directed to a hair adornment device which comprises a claw-type hair clip in conjunction with one or more lengths of hair, arranged in a novel and attractive combination. The claw-type hair clip, in itself well known, comprises a pair of hingedly connected clip elements, each having a plurality of spaced-apart tines positioned to be received in spaces between tines of the other clip element. A hinge pin and spring connects the clip elements for opening and closing movements, and each clip has a gripping element located on the opposite side of the clip element from the hinge pin. One or more lengths of hair are adhesively or otherwise secured to one or both clip elements in a manner that the hair, extending from the clip, covers substantial outwardly facing surface portions of the clip below the tines.

In one preferred embodiment of the invention, a length of hair is secured at one end to an outwardly facing surface of a gripping element of one of the clip elements and extends away from the clip such that, when the clip is attached to the hair of the user, the secured length of hair, which may be the same or a different color as the user's hair, extends downward in an eye-catching and attractive manner. Multiple lengths of hair may be secured to the clip in different areas, in each case, however, extending away from the clip in a manner to cover substantial outwardly facing surface portions of the clip below the tines thereof. The individual lengths of attached hair may be allowed to hang free, or may be gathered adjacent to but spaced from the gripping elements.

For a better understanding of the above and other features and advantages of the invention, reference should be made to the following detailed description of preferred embodiments thereof, and to the accompanying drawings.

DESCRIPTION OF PREFERRED EMBODIMENTS

Figure 1:
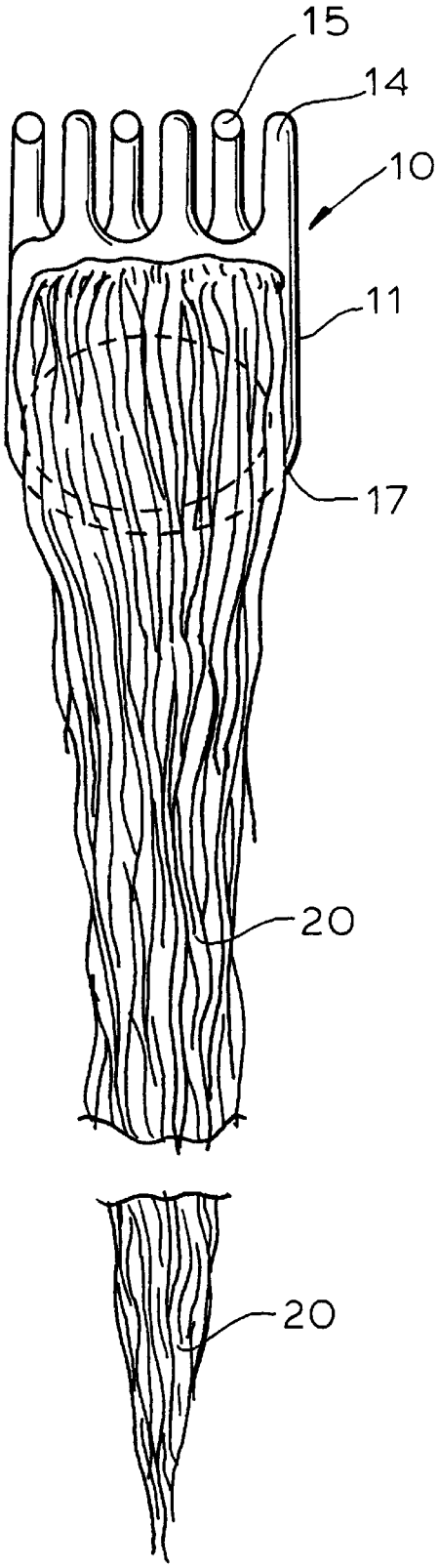
FIG. 1 is an elevational view, from one side, of a first embodiment of the hair adornment device of the invention.
Figure 2:
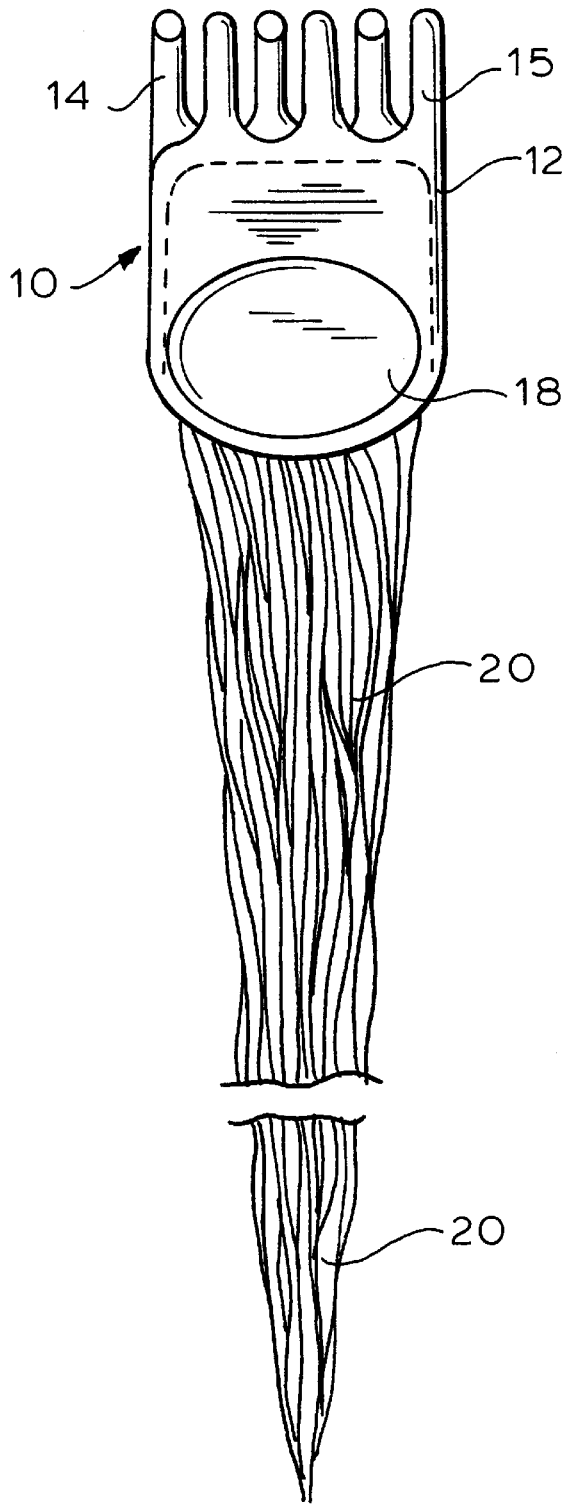
FIG. 2 is an elevational view from the opposite side thereof.

Referring now to the drawings, and initially to FIGS. 1–5 thereof, the reference numeral 10 designates generally a claw-type hair clip device consisting of two clip elements 11, 12 secured together for hinging movement by a hinge pin 13. At their upper ends, the clip elements 11, 12 are formed with tines 14, 15 respectively formed with spaces therebetween and arranged such that the tines 14 of the element 11 are received within the spaces between the tines 15 of the other element, and vice versa.

Figure 3:
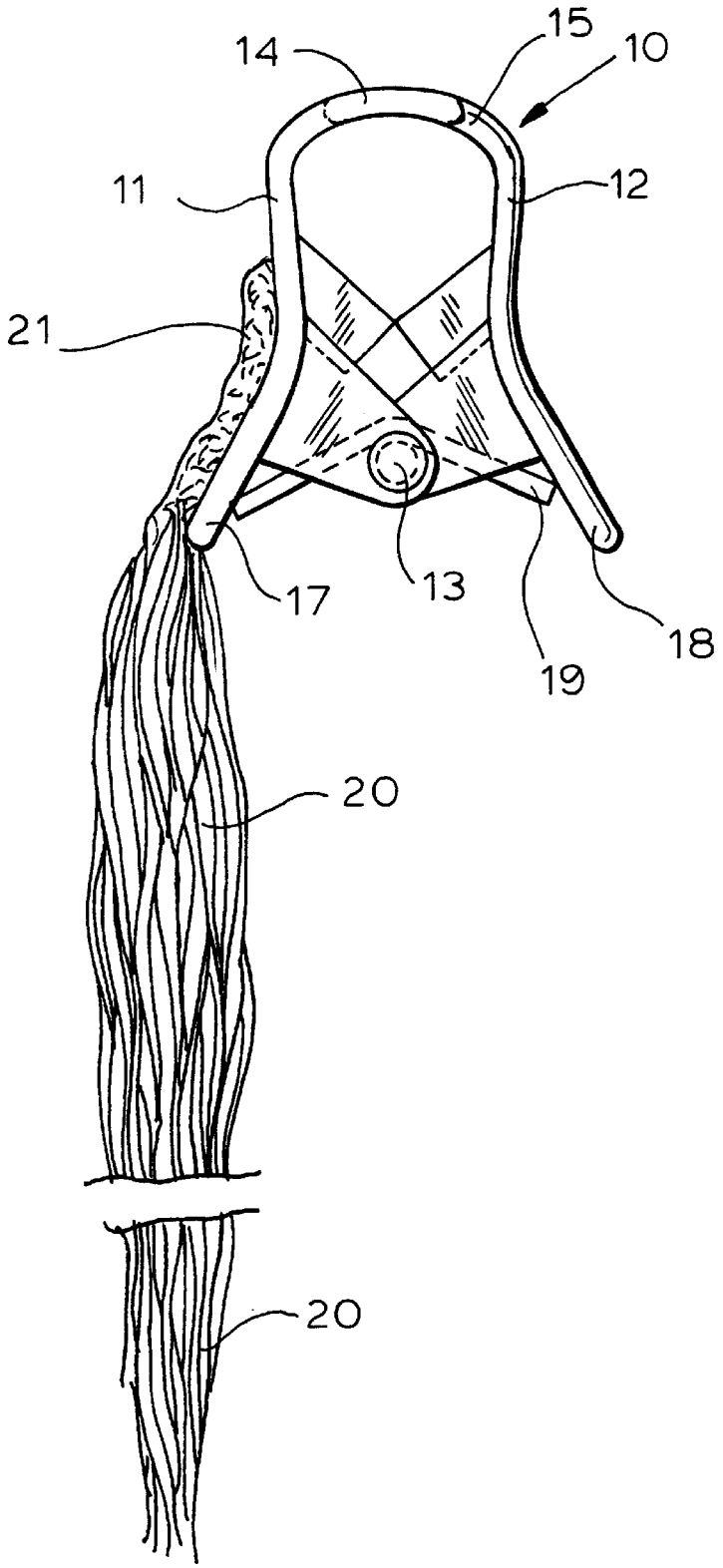
FIG. 3 is an end view.
Figure 5:
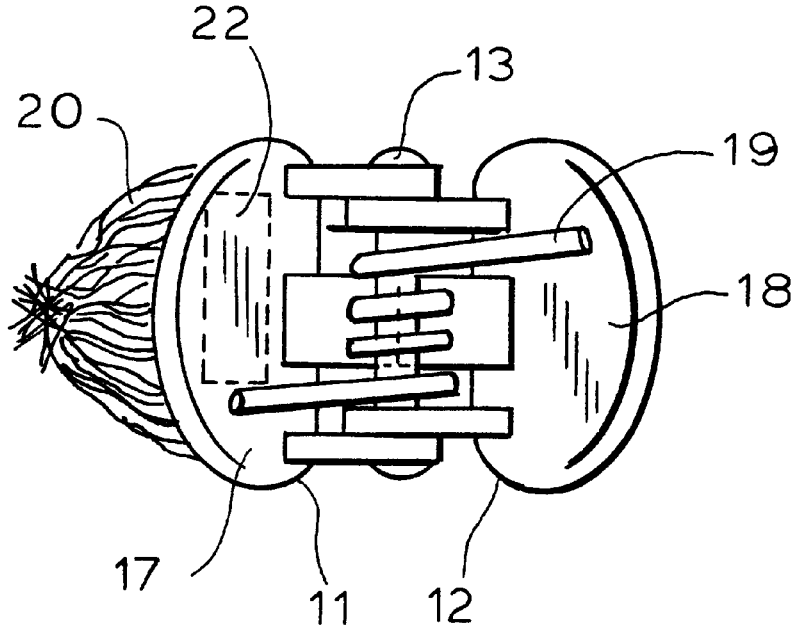
FIGS. 4 and 5 are top and bottom views respectively of the embodiment of FIG. 1.
Figure 4:
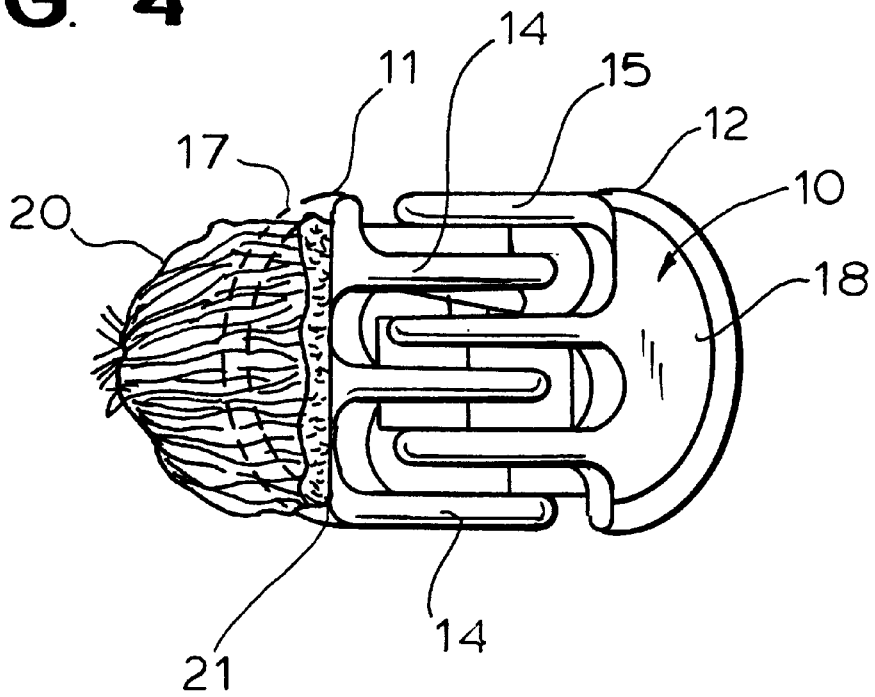

On the opposite end of each of the clip elements 11, 12 from the tines is a gripping element 17, 18 positioned generally on the opposite side of the hinge pin 13 from the tines 14, 15 such that, when the gripping elements are squeezed together, the tine portions of the clip elements separate to open the clip. A spring 19 normally urges the clip to a closed position, as shown in FIG. 3. The clip per se is a well known commercially available device. Pursuant to the invention, a simple, economical hair adornment device is formed by securing a length of hair 20, by one end 21 thereof, to a suitable surface of the clip 10. In the embodiment of FIGS. 1–5, only a single length of hair is employed, which may be either natural or artificial and advantageously is in the form of strip hair which is available commercially in rolls of substantial length, secured along one edge to form a selvage. The commercially available hair in such form is cut into narrower lengths, which can be suitably secured to the clip. In the embodiment of FIGS. 1–5, the selvage area of such a cut section is advantageously adhesively bonded to the outside surface of the clip, generally in the region of the gripping element 17, as reflected in FIG. 3. The free length of the hair hangs freely downward when the clip is in the orientation shown in the drawings, with the tines portion upward, and substantially covers the portions of the clip below the tines.

Most typically, the length of hair 20 is secured to the outer surface of the gripping member 17. However, it may be secured to other surfaces of the clip, such as an inner surface as indicated at 22 in FIG. 5. In all cases, the length of hair will extend away from the clip in a manner, as shown in FIG. 1, such that the hair substantially covers the outwardly facing surface areas of the clip below the tines.

Figure 6:
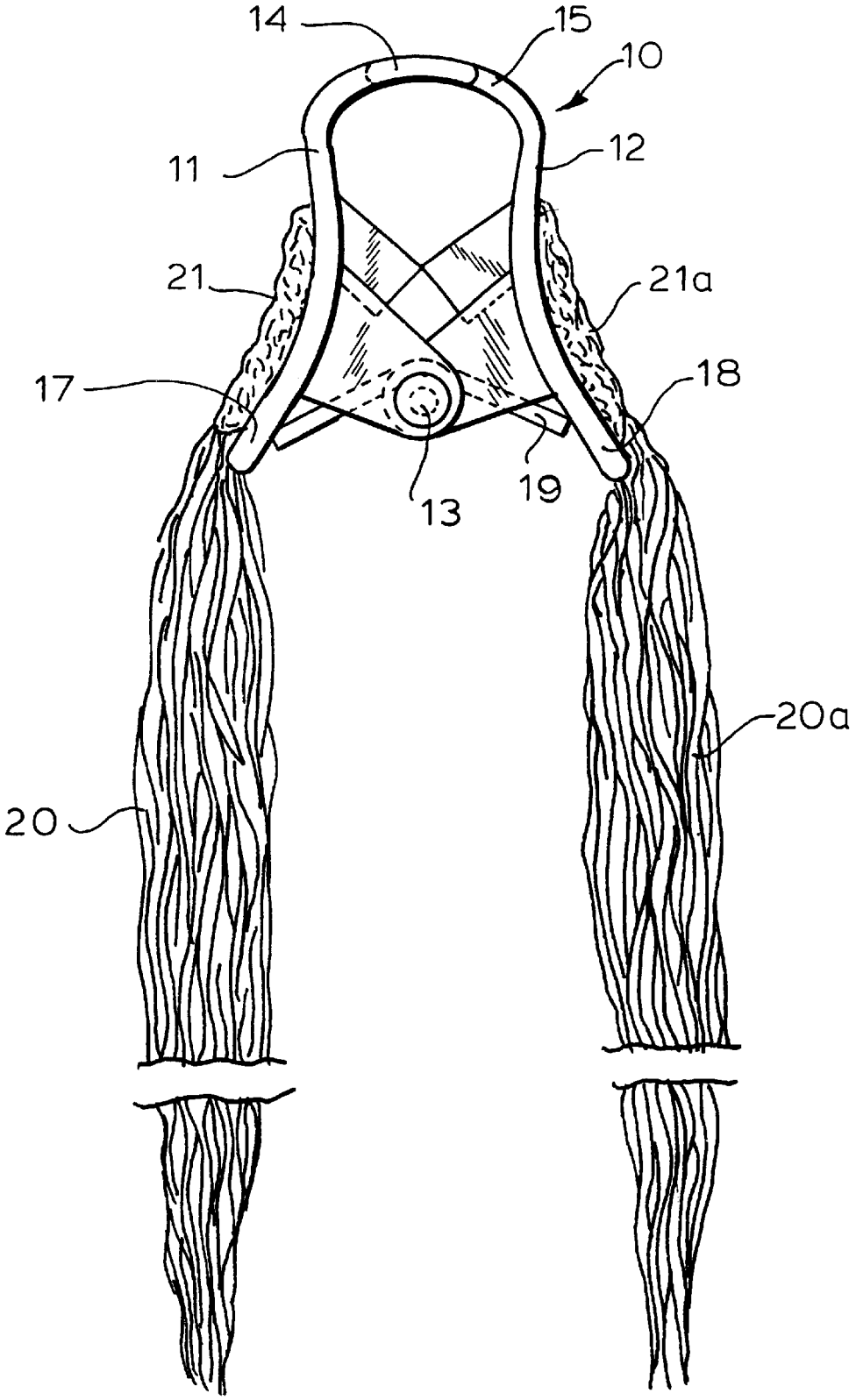
FIG. 6 is an end elevational view of a modification of the device of FIG. 1, formed with lengths of hair secured to each of the gripping elements.
Figure 8:
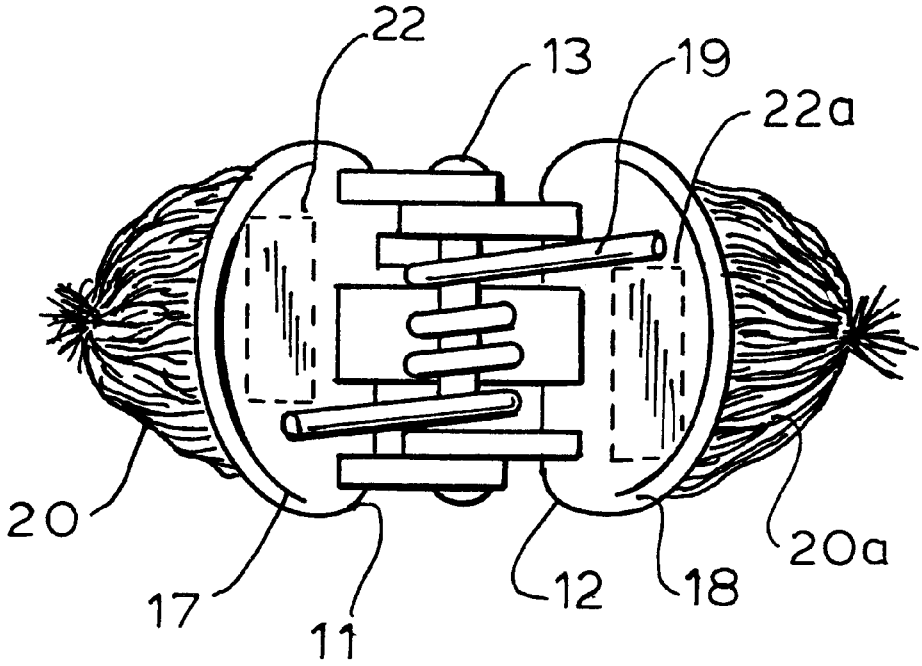
FIGS. 7 and 8 are top and bottom views respectively of the embodiment of FIG. 6.
Figure 7:
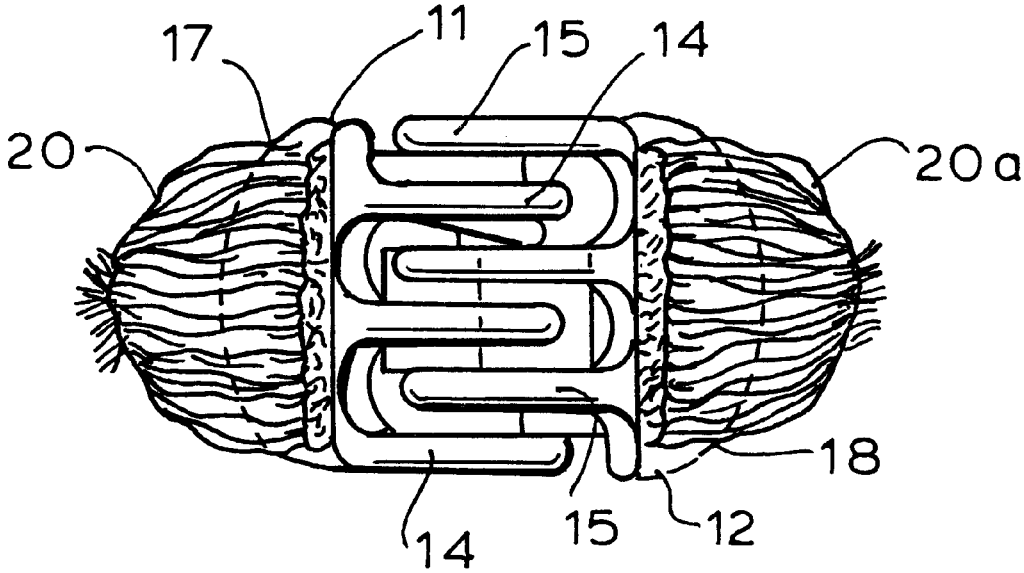
Figure 9:
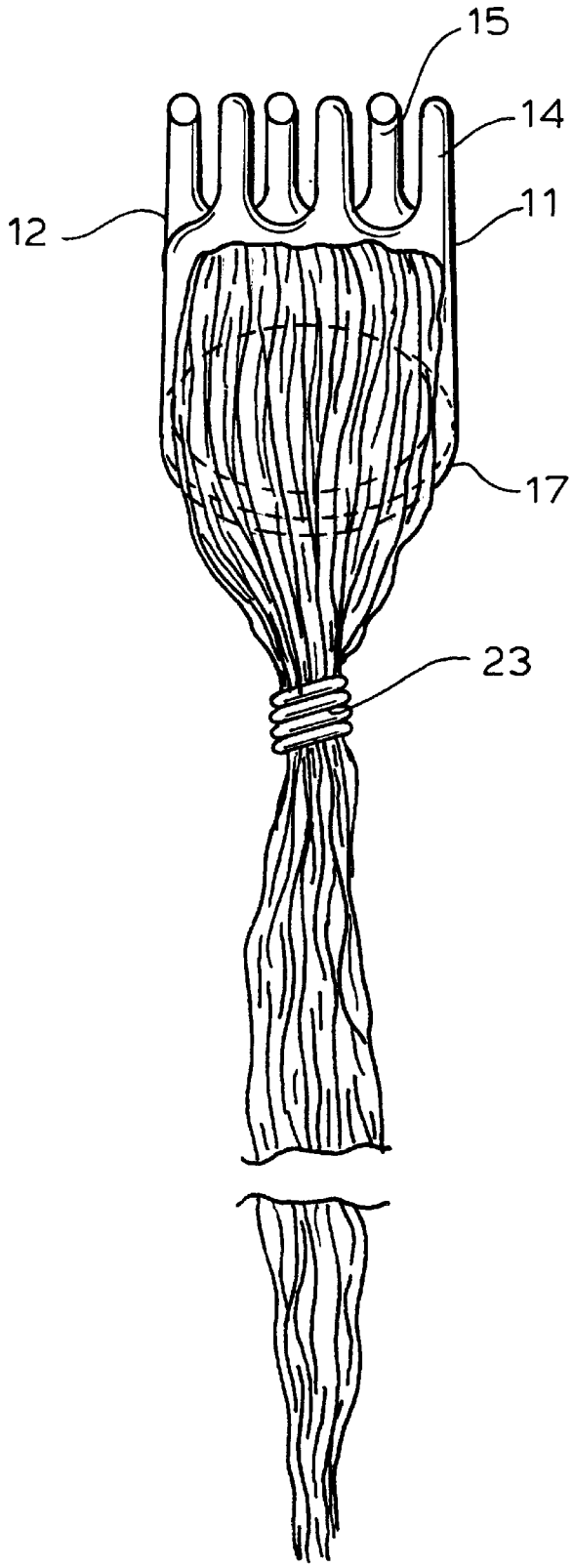
FIG. 9 is an elevational view of a further embodiment of the device of FIG. 1, formed with two or more lengths of hair gathered below the gripping elements.

In the embodiment of FIGS. 6–8, a claw-type clip 10 is shown, which is similar in all respects, to the clip of FIGS. 1–5, and has the same essential components identified by the same reference numerals. In the embodiment of FIGS. 6–8, however, two lengths of hair 20, 20*a* are provided, one secured to each of the clip elements 11, 12. In the illustrated embodiment, the hair sections 20, 20*a* are adhesively bonded or otherwise secured to external surfaces of the gripping element 17, 18, as indicated at 21, 21*a*. If desired, however, the lengths of hair may be secured to inner surfaces of the gripping elements, as at 22, 22*a*, in FIG. 8.

The clip of FIGS. 6–8 is attached to the hair by squeezing the gripping elements 17, 18 to open the tines.

Figure 10:
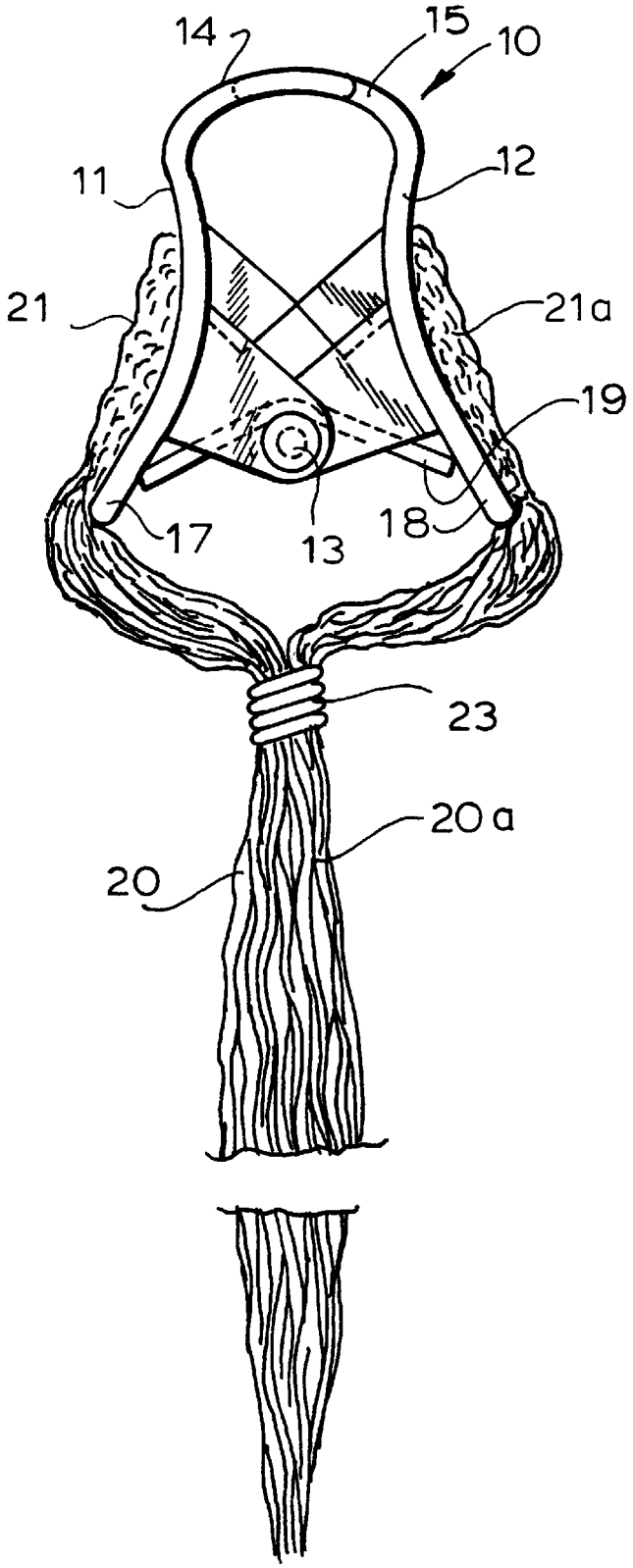
FIG. 10 is an end elevational view of the device of FIG. 9.
Figure 12:
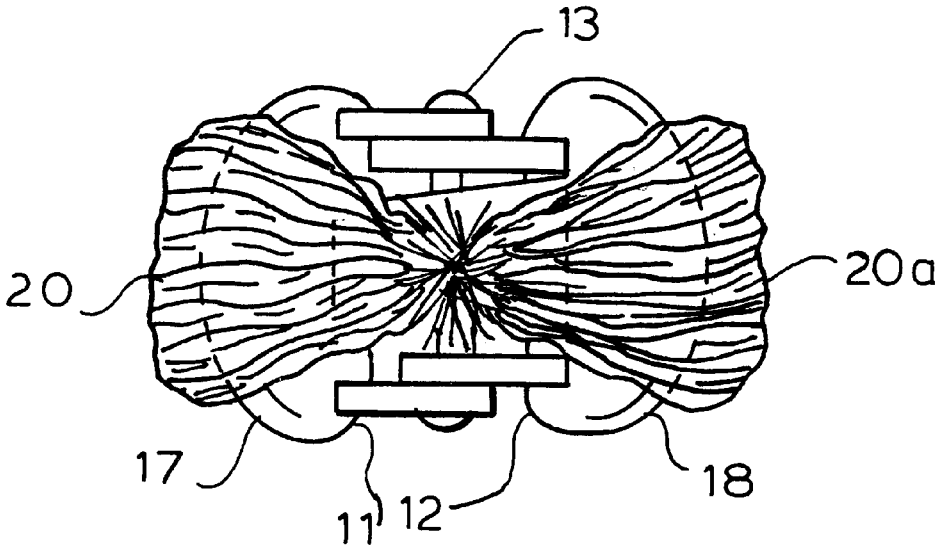
FIGS. 11, 12 are top and bottom views respectively of the device of FIG. 9.
Figure 11:
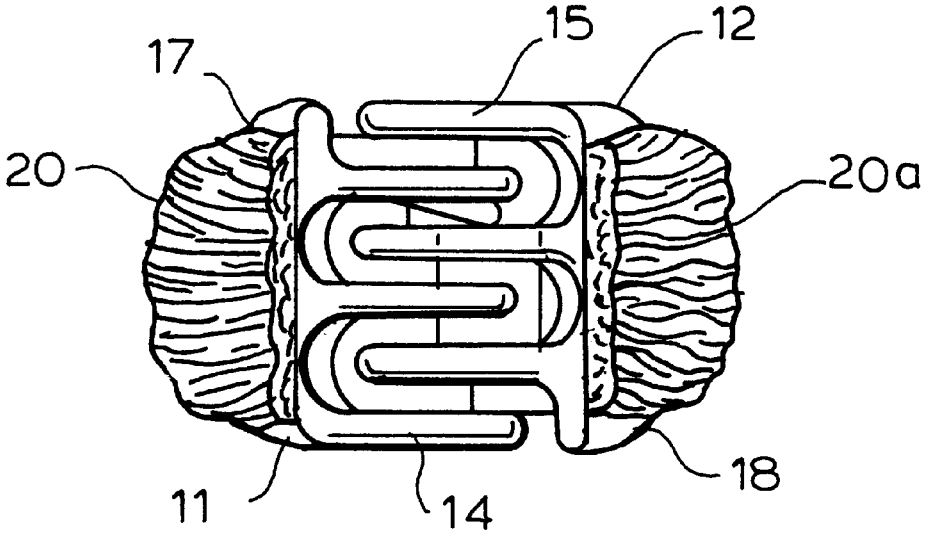

The embodiment of FIGS. 9–12 is similar to the embodiment of FIGS. 6–8, and where practicable similar reference numerals will be utilized to identify similar elements. Whereas in the embodiment of FIGS. 6–8, the lengths of hair 20, 20*a* hang freely downward from the respective clip elements 11, 12, in the embodiment of FIGS. 9–12, the hair lengths are gathered, by means of a suitable band 23 at a location adjacent to but spaced from the respective gripping elements 17, 18 of the clip 10. In the latter case, the two lengths of hair are generally merged below the collar 23, as indicated in FIG. 10. The device of FIGS. 9–12 is used in the same manner as the devices of FIGS. 1–8.

In any of its various forms, the device of the invention provides a simple, economical device, easily attached to the hair, which provides an attractive, eye-catching decoration to the user's hair.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

What is claimed is:

1. A hair adornment device which comprises:

(a) a claw-type hair clip comprising a pair of hingedly connected clip elements each including a first portion comprising a plurality of spaced-apart tines, positioned to be received in spaces between tines of the other clip element, and a second portion comprising remaining portions of the clip element, (b) the second portion of each clip element including a gripping element positioned on the side of said clip element opposite from the tines of the first portion of such clip element, and extending generally in a direction away from said tines, (c) a hinge pin positioned between and pivotally connecting said clip elements, and (d) lengths of hair secured to said clip elements and extending over and generally covering substantial portions of outwardly facing surfaces of said second portions of said clip elements.

2. The hair adornment device of claim 1 wherein (a) said lengths of hair are secured to outwardly facing surfaces of the gripping portions of said clip elements.

3. The hair adornment device of claim 1 wherein (a) said lengths of hair are disposed to substantially cover the outwardly facing surfaces of said second portions of said clip elements.

4. The hair adornment device of claim 1 wherein (a) said lengths of hair are adhesively secured to surface areas of said second portions of said clip elements.

5. The hair adornment device of claim 1 wherein (a) said lengths of hair are secured to the gripping portions of each of said clip elements, and (b) said lengths of hair extend generally in a direction away from said tines.

6. A hair adornment device which comprises:

(a) a claw-type hair clip comprising a pair of hingedly connected clip elements each including a first portion comprising a plurality of spaced-apart tines, positioned to be received in spaces between tines of the other clip element, and a second portion comprising remaining portions of the clip element, (b) the second portion of each clip element including a gripping element positioned on the side of said clip element opposite from the tines of the first portion of such clip element, and extending generally in a direction away from said tines, (c) a hinge pin positioned between and pivotally connecting said clip elements, and (d) at least one length of hair secured to at least one of said clip elements and extending over and generally covering substantial portions of outwardly facing surfaces of said second portion of said clip element.

7. The hair adornment device of claim 6 wherein (a) said at least one length of hair is disposed to substantially cover the outwardly facing surfaces of said second portion of said at least one clip element.

* * * * *